US005503577A

United States Patent [19]

Ming et al.

[11] Patent Number: 5,503,577

[45] Date of Patent: Apr. 2, 1996

[54] COMBINED FLYWHEEL AND TIMING GEAR COVER

[75] Inventors: Lam H. Ming, Tsing Yi Island; Chu K. Ying, Yuen Long, both of Hong Kong

[73] Assignee: Outboard Marine Corporation, Waukegan, Ill.

[21] Appl. No.: 268,836

[22] Filed: Jun. 29, 1994

[51] Int. Cl.[6] ..... B63H 21/24

[52] U.S. Cl. ..... 440/76; 440/900

[58] Field of Search ..... 440/53, 76–78, 440/900, 85, 84; 123/195 P, 198 E, 195 C, 413, 90.6, 149 C, 149 D; 74/572–574

[56] References Cited

U.S. PATENT DOCUMENTS

| | | | |
|---|---|---|---|
| 2,972,904 | 2/1961 | Troyer | 74/574 |
| 3,401,511 | 9/1968 | Weakly et al. | 74/574 |
| 4,721,485 | 1/1988 | Suzuki | 440/76 |
| 4,854,274 | 8/1989 | Dingess | 74/574 |
| 5,064,393 | 11/1991 | Inoue | 440/77 |
| 5,388,555 | 2/1995 | Shiomi et al. | 440/900 |

*Primary Examiner*—Edwin L. Swinehart
*Attorney, Agent, or Firm*—Michael, Best & Friedrich

[57] ABSTRACT

Disclosed herein is an outboard motor including an engine block assembly comprising an engine block, a crankshaft rotatably supported by the engine block and including an upper part above the engine block, a flywheel fixed on the upper part of the crankshaft, a recoil starter above the flywheel, a crankshaft timing gear fixed on the upper part of the crankshaft, a camshaft rotatably supported by the engine block and including an upper part above the engine block, a camshaft timing gear fixed to the upper part of the camshaft and located above the engine block, a timing belt extending between and around the crankshaft timing gear and the camshaft timing gear, and a one-piece cover mounted on the engine block and enclosing the flywheel, the recoil starter, the camshaft timing gear, and the timing belt, and a cowling enclosing the engine block assembly.

20 Claims, 2 Drawing Sheets

COMBINED FLYWHEEL AND TIMING GEAR COVER

BACKGROUND OF THE INVENTION

The invention relates generally to outboard motors and to outboard motors including a flywheel and flywheel cover.

More particularly, the invention relates to outboard motors including four stroke internal combustion engines which include a crankshaft and a camshaft and which also include, above the engine block assembly, a timing gear fixed on the crankshaft, a flywheel fixed on the crankshaft, a timing gear fixed on the camshaft, and a timing belt connecting the timing gears.

SUMMARY OF THE INVENTION

The invention provides an outboard motor including an engine block assembly comprising an engine block, a crankshaft rotatably supported by the engine block and including an upper part above the engine block, a flywheel fixed on the upper part of the crankshaft, a recoil starter located above the flywheel, a crankshaft timing gear fixed on the upper part of the crankshaft, a camshaft rotatably supported by the engine block and including an upper part above the engine block, a camshaft timing gear fixed to the upper part of the camshaft and located above the engine block, a timing belt extending between and around the crankshaft timing gear and the camshaft timing gear, and a one-piece cover mounted on the engine block and enclosing the flywheel, the recoil starter, the camshaft timing gear, and the timing belt, and a cowling enclosing the engine block assembly.

The invention also provides a flywheel, recoil starter, and camshaft timing gear cover comprising a combined flywheel housing and recoil starter housing portion including a recoil starter housing sub-portion and a flywheel housing sub-portion, a camshaft timing gear portion, and an intermediate portion connecting the flywheel portion and the camshaft timing gear portion.

Other features and advantages of the invention will become apparent to those skilled in the art upon review of the following detailed description, claims and drawings.

Figure 2:
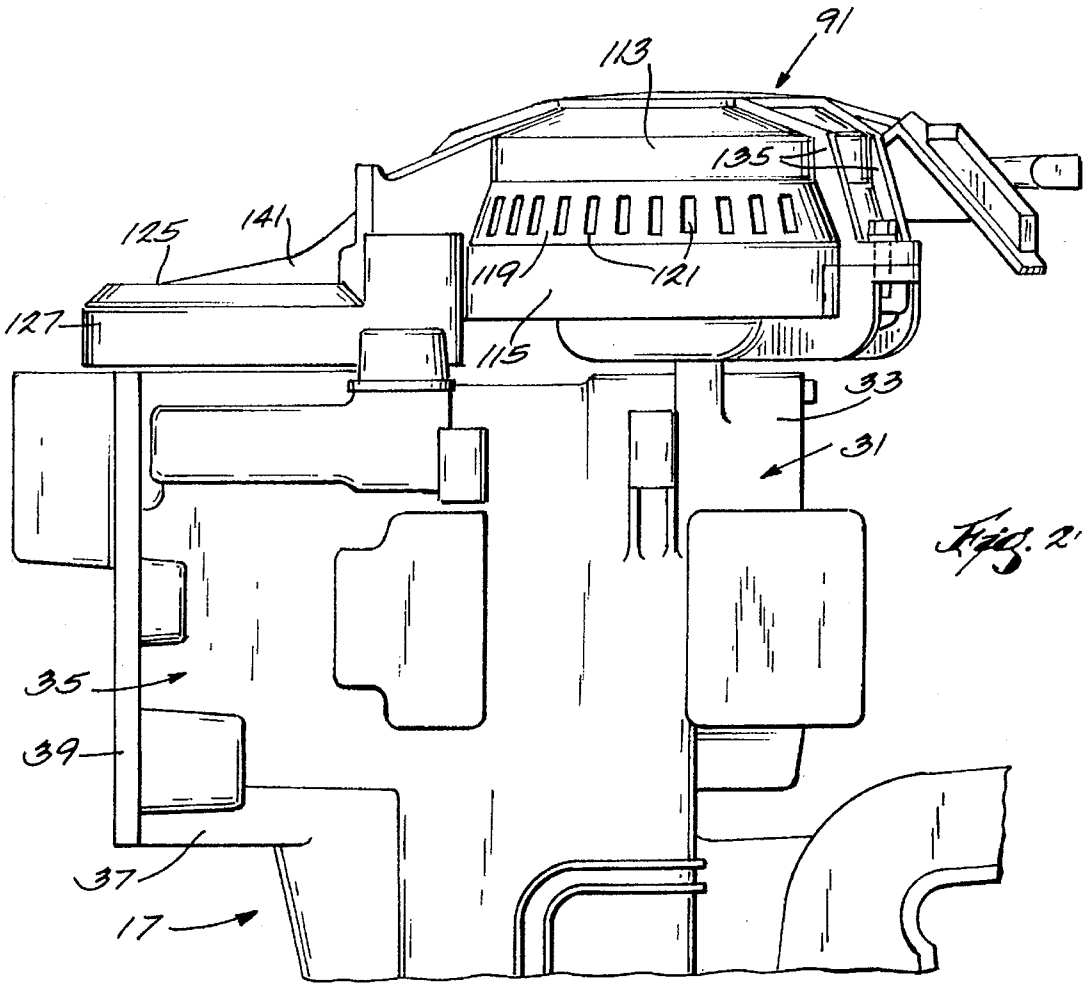
FIG. 2 is an enlarged fragmentary side elevational view of an engine block incorporated in the outboard motor shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 1:
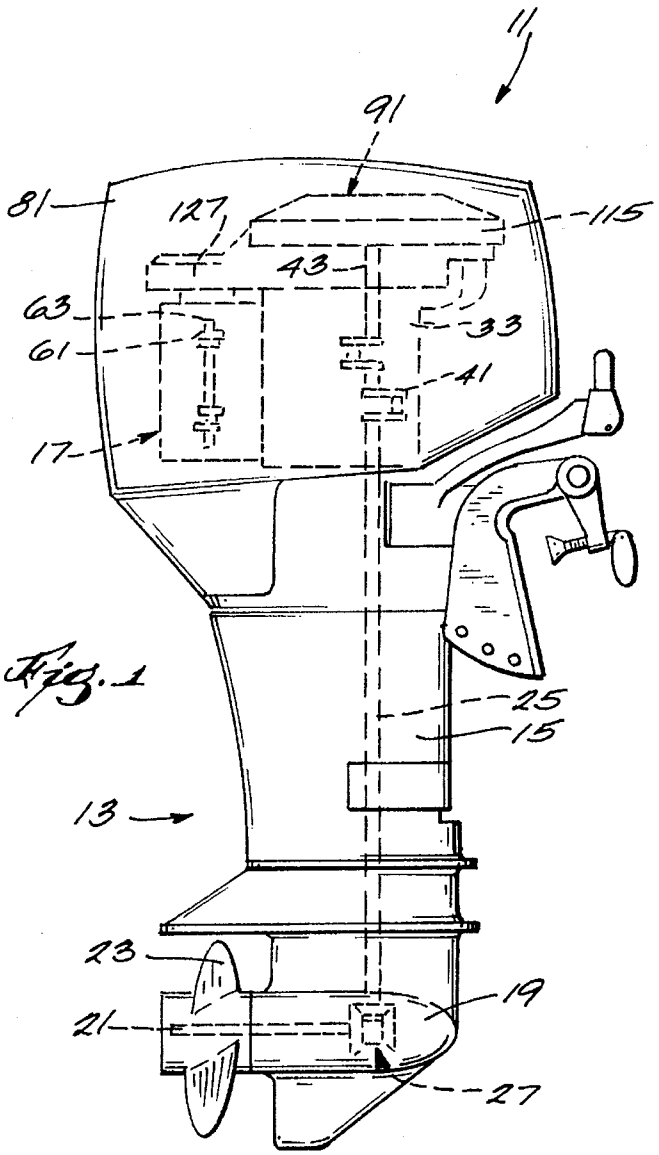
FIG. 1 is a side elevational view of an outboard motor incorporating various other features of the invention.
Figure 3:
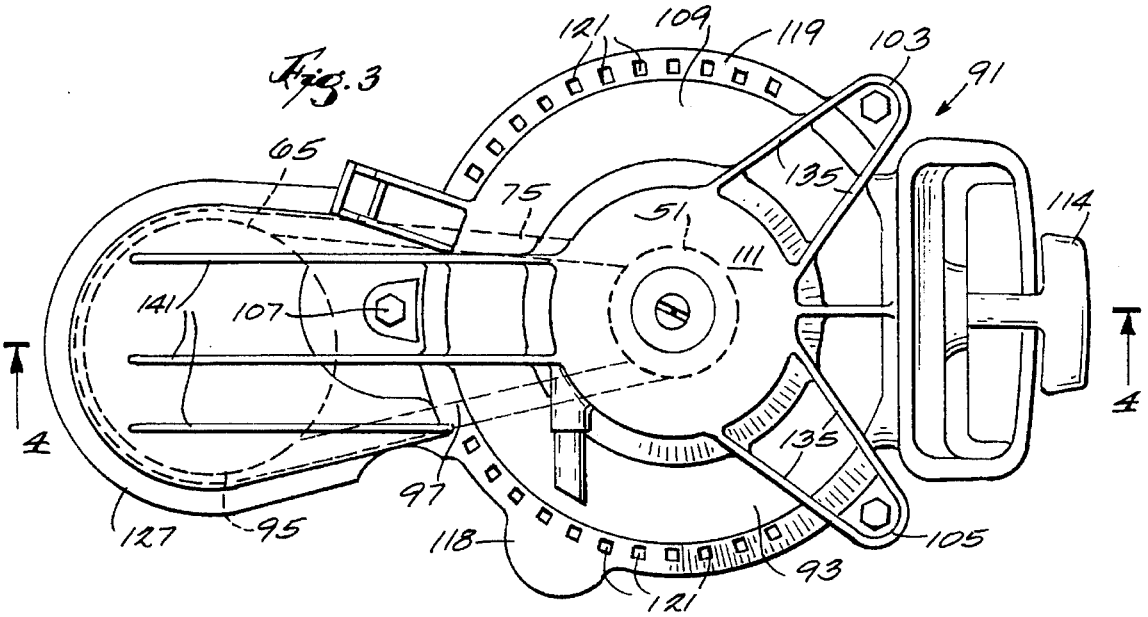
FIG. 3 is a fragmentary top plan view of the engine block assembly shown in FIG. 1.
Figure 4:
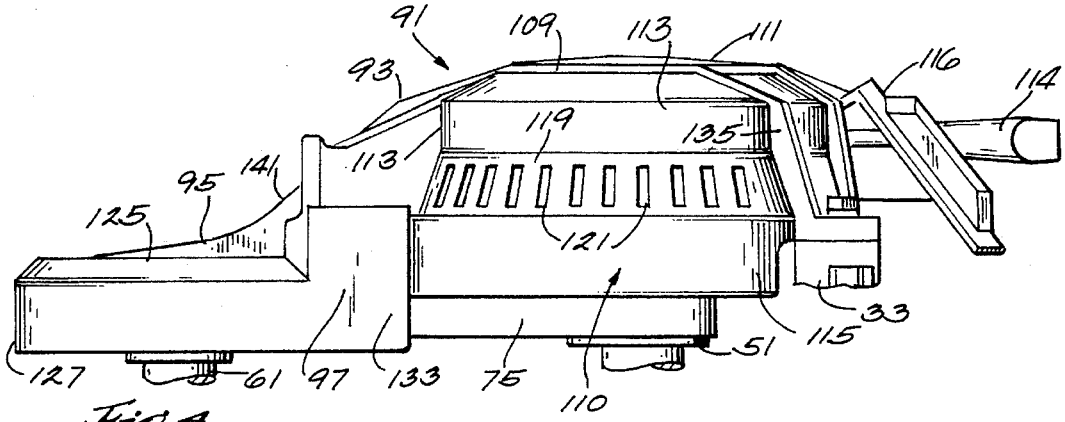
FIG. 4 is a fragmentary side elevational view similar to FIG. 2 and showing the engine block assembly shown in FIG. 2.

Shown in FIG. 1 of the drawings is an outboard motor 11 including a lower unit 13 comprising a driveshaft housing 15 having an upper end to which a powerhead assembly 17 is rigidly connected. The driveshaft housing 15 also includes a lower end to which is rigidly connected is a gearcase assembly 19 rotatably supporting a propeller shaft 21 carrying a propeller 23.

The lower unit 13 also includes a driveshaft 25 which is rotatably supported in the driveshaft housing 15 and which, at its lower end, is drivingly connected through a transmission 27 with the propeller shaft 21.

The powerhead assembly 17 includes an internal combustion engine comprising an engine block assembly 31 including a cylinder block 33 which defines one or more cylinders (not shown) and to which is attached a cylinder head 35 which, in part, defines a camcase 37 closed by a camcase cover 39 fixed to the cylinder head 35.

Rotatably supported by the cylinder block 33 is a crankshaft 41 which, at its upper end, includes a part 43 extending above the upper surface of the cylinder block 33 and which, at its lower end, is drivingly connected to the driveshaft 25.

Fixed to the upper part 43 of the crankshaft 41 for common rotation therewith is a crankshaft timing gear 51 and a flywheel 53 which includes a peripheral starting gear 55. If desired, the flywheel 53 and crankshaft timing gear 51 can be unified in a combined flywheel assembly. It is noted further that, in the disclosed construction, the crankshaft timing gear 51 is located underneath the flywheel 53 and is of substantially lesser diameter.

Figure 5:
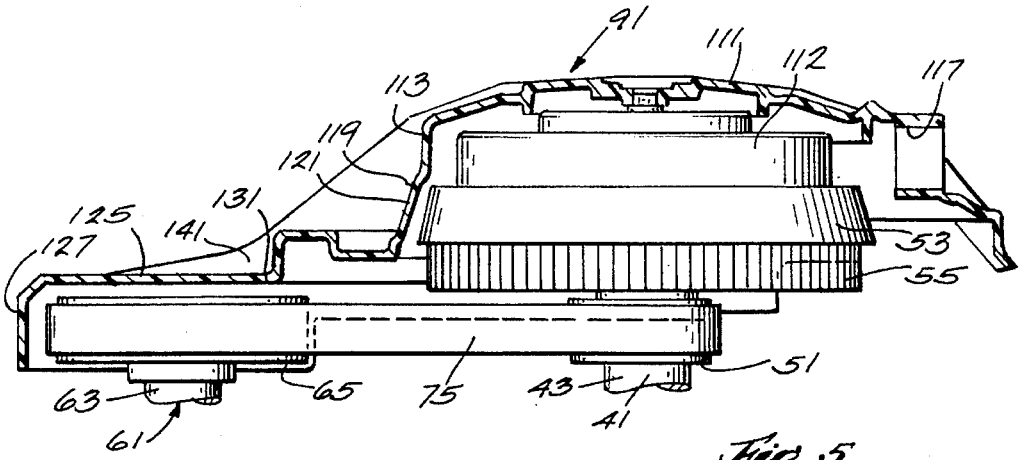
FIG. 5 is a sectional view taken along line 5—5 of FIG. 3.

Located above the flywheel 53 is a recoil starter 112 including a pull rope 114 (see FIG. 5).

Rotatably supported in the cylinder head 35 or camcase 37 is a camshaft 61 having an upper end or part 63 above the upper surface of the cylinder head 35. Fixed to the upper end 63 of the camshaft 61 is a camshaft timing gear 65 which is generally coplanar with the crankshaft timing gear 51.

Extending between and around the crankshaft timing gear 51 and the camshaft timing gear 65 is an endless timing belt 75.

Enclosing the powerhead assembly 17 is an outer cowling 81 which can be supported by the engine block assembly 31, or by the driveshaft housing 15, or by both the engine block assembly 31 and the driveshaft housing 15.

As above described, the construction is conventional and any suitable arrangement can be employed.

The engine block assembly 31 also includes a one-piece cover 91 which can be fabricated of various materials and which, in the disclosed construction, is fabricated of plastic, which is fixedly mounted on the engine block assembly 31, which is spaced inwardly of and is generally unconnected to the engine cowling 81, and which encloses the flywheel 53, a recoil starter 112 (shown schematically in FIG. 5), the camshaft timing gear 65, and the timing belt 75.

The one-piece cover 91 includes a combined flywheel housing and recoil starter housing portion 93, a camshaft timing gear portion 95, an intermediate portion 97 located therebetween, and three mounting pads 101, 103, and 105.

The combined flywheel housing and recoil starter housing portion 93 includes a sub-portion 109 housing the recoil starter 112 and comprising a top part 111 located in spaced relation above the flywheel 53 and a generally cylindrical part 113 extending downwardly from the outer periphery of the top part 111 to define a space accommodating the recoil starter 112.

The combined flywheel housing and recoil starter housing portion 93 also comprises a sub-portion 110 which houses the flywheel 53 and which includes port and starboard arcuate skirts 115 extending in laterally adjacent relation to the outer periphery of the flywheel 53 and downwardly to adjacent the bottom of the flywheel 53.

The combined flywheel housing and recoil starter housing portion 93 also includes, intermediate the cylindrical part 113 and the skirts 115, an intermediate part 119 which is of frustro-conical shape and which includes a series of angularly spaced openings 121 permitting air flow into the area under the cover 91.

Because the engine is adapted to operate either with the recoil starter 112 which is shown schematically in FIG. 5, or with an electrical starter (not shown), the combined flywheel housing and recoil starter housing portion 93 also includes, in order to accommodate the pull rope 114, a forwardly located part 116 which is generally of conventional construction and which includes an opening 117 permitting entry into and under the cover 91 of the starter pull rope 114.

In order to accommodate electrical starting one of the skirts 115 of the flywheel portion includes, on one side, a laterally outwardly extending bulbous semi-cylindrical portion 118 adapted to enclose a starter pinion (not shown) forming part of the electrical starter.

The camshaft timing gear portion 95 is located at a somewhat lower level than the flywheel portion 93 encircles the camshaft timing gear 65, and includes a top 125 and a skirt 127 which extends downwardly from top 125 in laterally adjacent relation to the outer periphery of the camshaft timing gear 65 and adjacent the bottom of the camshaft timing gear 65.

The intermediate portion 97 encloses the portion of the timing belt 75 extending from underneath the flywheel 53 to the camshaft timing gear 65 and includes a top 131 and a skirt 133 extending downwardly to the level of the bottom of the flywheel portion skirts 115.

The cover 91 is fixed to the engine block assembly 31 by the before mentioned mounting pads 103, 105 and 107 which are angularly spaced at about 120° from each other. The pads 103 and 105 extend from the flywheel portion 93 and the pad 107 is located centrally in the intermediate portion 9? . The pads 103 and 105 are fixed to the upper surface of the cylinder block 33 and the pad 107 is fixed to the upper surface of the cylinder head 35 by suitable threaded fasteners.

In the disclosed construction the connection of each of the pads 103 and 105 to the flywheel portion 93 is strengthened , by two angularly spaced and vertical ribs 135 which upwardly converge and which extend from the intermediate part 119, from the cylindrical sub-portion 113, and from the top 111 part of the flywheel portion 93 of the cover 91.

In order to additionally strengthen the cover 91, one or more vertically projecting ribs 141 extends upwardly from the top 131 of the intermediate portion 97, and from the top 125 of the camshaft timing gear portion 95, to the cylindrical part 113 and to the intermediate flywheel part 110. In the disclosed construction, three such laterally spaced vertically extending ribs 141 are employed.

The disclosed construction provides a particularly economical arrangement for enclosing the flywheel 53, the recoil starter 112, the camshaft timing gear 65, and the timing belt 75 and without connection thereto so as to render the flywheel 53, the recoil starter, the crankshaft timing gear 51, the camshaft timing gear 65 and the timing belt 75 generally inaccessible in the absence of removal of the cover 91.

Various of the feature of the invention are set forth in the following claims.

We claim:

1. An outboard motor including an engine block assembly comprising an engine block, a crankshaft rotatably supported by said engine block and including an upper part above said engine block, a flywheel fixed on said upper part of said crankshaft, a recoil starter located above the flywheel, a crankshaft timing gear fixed on said upper part of said crankshaft, a camshaft rotatably supported by said engine block and including an upper part above said engine block, a camshaft timing gear fixed to said upper part of said camshaft and located above said engine block, a timing belt extending between and around said crankshaft timing gear and said camshaft timing gear, and a one-piece cover mounted on said engine block and enclosing said flywheel, said recoil starter, said camshaft timing gear, and said timing belt without connection thereto, and a cowling enclosing said engine block assembly.

2. An outboard motor in accordance with claim 1 wherein said engine block includes a cylinder block and a cylinder head.

3. An outboard motor in accordance with claim 2 wherein said crankshaft is rotatably mounted in said cylinder block and said camshaft is rotatably mounted in said cylinder head.

4. An outboard motor in accordance with claim 2 wherein said cover is fixed, in part, to said cylinder block and, in part, to said cylinder head.

5. An outboard motor in accordance with claim 1 wherein said crankshaft timing gear and said flywheel comprise portions of a combined flywheel assembly.

6. An outboard motor in accordance with claim 1 where said timing gears are generally co-planar and wherein said flywheel is located above said crankshaft timing gear.

7. An outboard motor in accordance with claim 1 wherein said cover includes a combined flywheel housing and recoil starter housing portion, a camshaft timing gear portion, and an intermediate portion connecting said combined portion and said camshaft timing gear portion.

8. An outboard motor in accordance with claim 7 wherein said camshaft timing gear portion includes a top, and wherein said cover includes at least one rib extending in upstanding relation from said top of said camshaft timing gear portion and from said intermediate portion and connected to said flywheel portion.

9. An outboard motor including an engine block assembly comprising an engine block, a crankshaft rotatably supported by said engine block and including an upper part above said engine block, a flywheel fixed on said upper part of said crankshaft, a recoil starter located above the flywheel, a crankshaft timing gear fixed on said upper part of said crankshaft, a camshaft rotatably supported by said engine block and including an upper part above said engine block, a camshaft timing gear fixed to said upper part of said camshaft and located above said engine block, a timing belt extending between and around said crankshaft timing gear and said camshaft timing gear, and a one-piece cover mounted on said engine block, enclosing said flywheel, said recoil starter, said camshaft timing gear, and said timing belt, and including a combined flywheel housing and recoil starter housing portion including a recoil starter housing sub-portion including a top part and a cylindrical part extending downwardly from said top part, and a flywheel housing sub-portion including port and starboard skirts, and a frustro-conical part extending downwardly from said cylindrical part and to said port and starboard skirts, camshaft timing gear portion, and an intermediate portion connecting said combined portion and said camshaft timing gear portion, and a cowling enclosing said engine block assembly.

10. An outboard motor in accordance with claim 9 wherein said frustro-conical part includes a circular series of spaced apertures.

11. An outboard motor in accordance with claim 9 wherein said camshaft timing gear portion is located below said frustro-conical part of said flywheel portion.

12. An outboard motor in accordance with claim 9 wherein said recoil starter housing sub-portion is located above said flywheel.

13. A flywheel, recoil starter, and camshaft timing gear cover comprising a combined flywheel housing and recoil starter housing portion including a recoil starter housing sub-portion and a flywheel housing sub-portion, a camshaft timing gear portion including, an intermediate portion connecting said combined portion and said camshaft timing gear portion, and at least one rib extending in upstanding relation from said top of said camshaft timing portion and from said intermediate portion and connected to said combined portion.

14. A flywheel, recoil starter, and camshaft timing gear cover in accordance with claim 13 wherein said camshaft timing gear portion also includes a partially cylindrical skirt extending from said top.

15. A flywheel, recoil starter, and camshaft timing gear cover in accordance with claim 13 wherein said combined portion includes first and second mounting pads adapted to be fixed to a cylinder block, and wherein said intermediate portion include a third mounting pad adapted to be fixed to one of a cylinder block and a cylinder head.

16. A flywheel, recoil starter, and camshaft timing gear cover in accordance with claim 13 wherein said recoil starter housing sub-portion is located above said flywheel housing sub-portion.

17. A flywheel, recoil starter, and camshaft timing gear cover comprising a combined flywheel housing and recoil starter housing portion including a recoil starter housing sub-portion including a top part and a cylindrical part extending downwardly from said top part, and a flywheel housing sub-portion including port and starboard skirts, and a frustro-conical part extending downwardly from said cylindrical part and to said port and starboard skirts, a camshaft timing gear portion, and an intermediate portion connecting said combined portion and said camshaft timing gear portion.

18. A flywheel, recoil starter, and camshaft timing gear cover in accordance with claim 17 wherein said frustro-conical part includes a circular series of spaced apertures.

19. A flywheel, recoil starter, and camshaft timing gear cover in accordance with claim 17 wherein said camshaft timing gear portion is laterally spaced from and located below said frustro-conical part of said flywheel portion.

20. A flywheel, recoil starter, and camshaft timing gear cover in accordance with claim 17 wherein said camshaft timing gear portion includes a top, and wherein said cover includes at least one rib extending in upstanding relation from said top of said camshaft timing portion and from said intermediate portion and connected to said combined portion.

* * * * *